United States Patent [19]

Isobe et al.

[11] Patent Number: 4,462,375

[45] Date of Patent: Jul. 31, 1984

[54] METHOD AND APPARATUS FOR CONTROLLING FUEL SUPPLY OF AN INTERNAL COMBUSTION ENGINE

[75] Inventors: Toshiaki Isobe, Nagoya; Nobuhisa Ohkawa, Toyota, both of Japan

[73] Assignee: Toyota Jidosha Kabushiki Kaisha, Toyota, Japan

[21] Appl. No.: 476,405

[22] Filed: Mar. 17, 1983

[30] Foreign Application Priority Data

Mar. 23, 1982 [JP] Japan ..... 57-044645

[51] Int. Cl.[3] ..... F02M 17/00

[52] U.S. Cl. ..... 123/491; 123/488; 123/179 L

[58] Field of Search ..... 123/491, 179 L, 179 G, 123/492, 493, 488

[56] References Cited

U.S. PATENT DOCUMENTS

| | | | |
|---|---|---|---|
| 3,982,503 | 9/1976 | Keranen | 123/491 |
| 4,050,878 | 9/1977 | Priegel | 123/491 |
| 4,352,158 | 9/1982 | Date | 123/492 |

FOREIGN PATENT DOCUMENTS

| | | | |
|---|---|---|---|
| 54-12045 | 1/1979 | Japan | 123/491 |

*Primary Examiner*—Ronald B. Cox

*Attorney, Agent, or Firm*—Cushman, Darby & Cushman

[57] ABSTRACT

Fuel supply to an internal combustion engines is controlled in accordance with the intake manifold pneumatic pressure and with engine running speed. The fuel supply is corrected in accordance with the outer air temperature and with the temperature corresponding to an air intake passage temperature so that the changing rate of fuel supply with respect to the change of the outer air temperature increases to when the temperature corresponding to the intake passage temperature decreases.

10 Claims, 6 Drawing Figures

METHOD AND APPARATUS FOR CONTROLLING FUEL SUPPLY OF AN INTERNAL COMBUSTION ENGINE

BACKGROUND OF THE INVENTION

1. Field of the Invention

The present invention relates to a fuel supply control method and apparatus for an internal combustion engine.

2. Description of the Prior Art

In one known fuel supply control method, the engine running speed and the intake manifold pneumatic pressure are detected and then used to calculate the basic pulse width of an injection signal to be applied to the fuel injectors or to the fuel adjustment valves. This basic pulse width is corrected in accordance with the temperature of outer air introduced into the engine so as to compensate for deviation of the density of air in the intake manifold due to changes of the outer air temperature. The corrected pulse-width is used to adjust the actual fuel feed.

When the outer air temperature is high, the density of the air in the intake manifold decreases, although the intake manifold pneumatic pressure is constant. This causes the air-fuel ratio of the mixture introduced into combustion chambers to be rich relative to a stoichiometric condition. Contrary to this, when the outer air temperature is low, the density of the intake manifold air increases, causing the air-fuel ratio to be lean relative to a stoichiometric condition. Therefore, the fuel feed is corrected in accordance with the outer air temperature to compensate for deviation of the density of the intake manifold air and to control the air-fuel ratio to the stoichiometric condition.

However, according to the preceding system, since the air temperature is detected at an entrance of an air intake passage, the detected outer air temperature sometimes deviates from the actual temperature of air in the intake manifold. When the engine temperature varies, this deviation of the detected outer air temperature from the intake manifold air temperature increases particularly extremely. Thus, accurate correction of the air density cannot be executed.

SUMMARY OF THE INVENTION

It is, therefore, an object of the present invention to provide a method and apparatus for controlling the fuel supply of an internal combustion engine, wherein the deviation of air-fuel ratio depending upon the change of the density of air introduced into the engine can be accurately compensated.

The above object will be achieved by a fuel supply control method comprising the steps of: detecting the engine running speed to produce a first electrical signal; detecting the intake manifold pneumatic pressure to produce a second electrical signal; detecting the temperature of the outer air of the engine to produce a third electrical signal; detecting the temperature corresponding to the temperature of the air intake passage to produce a fourth electrical signal; calculating, in response to the first and second electrical signals, a value which corresponds to a basic fuel feed to the engine; correcting, in response to the third and fourth electrical signals, the calculated value for the fuel feed so that a changing rate of fuel feed with respect to change of the outer air temperature increases to when the temperature corresponding to the air intake passage temperature decreases; and adjusting, in response to the corrected value for the fuel feed, the actual fuel feed to the engine.

Furthermore, the above object will also be achieved by a fuel supply control apparatus comprising: means for detecting the engine running speed to produce a first electrical signal; means for detecting the intake manifold pneumatic pressure to produce a second electrical signal; means for detecting the temperature of the outer air of the engine to produce a third electrical signal; means for detecting the temperature corresponding to the temperature of the air intake passage to produce a fourth electrical signal; processing means for (1) calculating, in response to the first and second electrical signals, a value which corresponds to a basic fuel feed to the engine, and (2) correcting, in response to the third and fourth electrical signals, the calculated value for the fuel feed so that a changing rate of fuel feed with respect to change of the outer air temperature increases to when the temperature corresponding to the air intake passage temperature decreases; and means for adjusting, in response to the corrected value for the fuel feed, the actual fuel feed to the engine.

The above and other related objects and features of the present invention will be apparent from the description of the present invention set forth below, with reference to the accompanying drawings, as well as from the appended claims.

DESCRIPTION OF THE PREFERRED EMBODIMENTS

Figure 1:
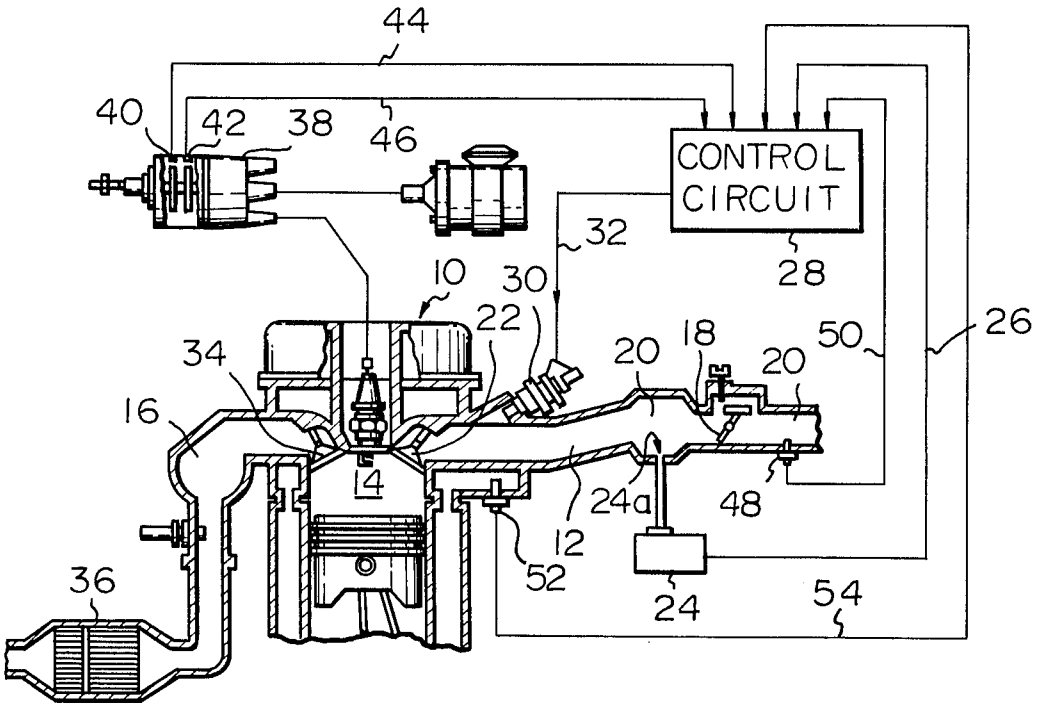
FIG. 1 is a schematic diagram of an electronic fuel injection control system of an internal combustion engine according to the present invention.

In FIG. 1, reference numeral 10 denotes an engine body, 12 an air intake passage, 14 a combustion chamber, and 16 an exhaust passage. The flow rate of outer air introduced into the engine through an air cleaner (not shown) is controlled by a throttle valve 18 interlocked with an accelerator pedal (not shown). The air passing through the throttle valve 18 is introduced into the combustion chamber 14 via a surge tank 20 and an intake valve 22.

In the intake passage 12, at a position downstream of the throttle valve 18, for example, at a position of the surge tank 20, a pressure take-out port 24*a* is opened. The pressure take-out port 24*a* is communicated with a pneumatic pressure sensor 24 which detects the absolute pneumatic pressure in the intake manifold and produces a voltage corresponding to the detected pressure. The output voltage from the pneumatic pressure sensor 24 is fed to a control circuit 28 via a line 26.

Each of fuel injectors 30 for the cylinders is opened and closed in response to electrical drive pulses fed from the control circuit 28 via a line 32. The fuel injectors 30 intermittently inject into the intake passage 12 compressed fuel from a fuel supply system (not shown) in the vicinity of the intake valve 22.

The exhaust gas produced due to combustion in the combustion chamber 14 is emitted into the atmosphere via an exhaust valve 34, the exhaust passage 16, and catalytic converter 36.

Crank angle sensors 40 and 42 disposed in a distributor 38 produce pulse signals at every crank angle of 30° and 360°, respectively. The pulse signals produced at every 30° crank angle are fed to the control circuit 28 via a line 44. The pulse signals produced at every 360° crank angle are fed to the control circuit 28 via a line 46.

An outer air temperature sensor 48 disposed in the intake passage 20 at a position upstream of the throttle valve 18 produces a voltage which indicates the detected temperature of outer air introduced into the combustion chambers via the intake passage 20. The output voltage from the outer air temperature sensor 48 is fed to the control circuit 28 via a line 50.

A coolant temperature sensor 52 disposed on the cylinder block of the engine produces a voltage indicative of the coolant temperature. The output voltage from the coolant temperature sensor 52 is fed to the control circuit 28 via a line 54.

Figure 2:
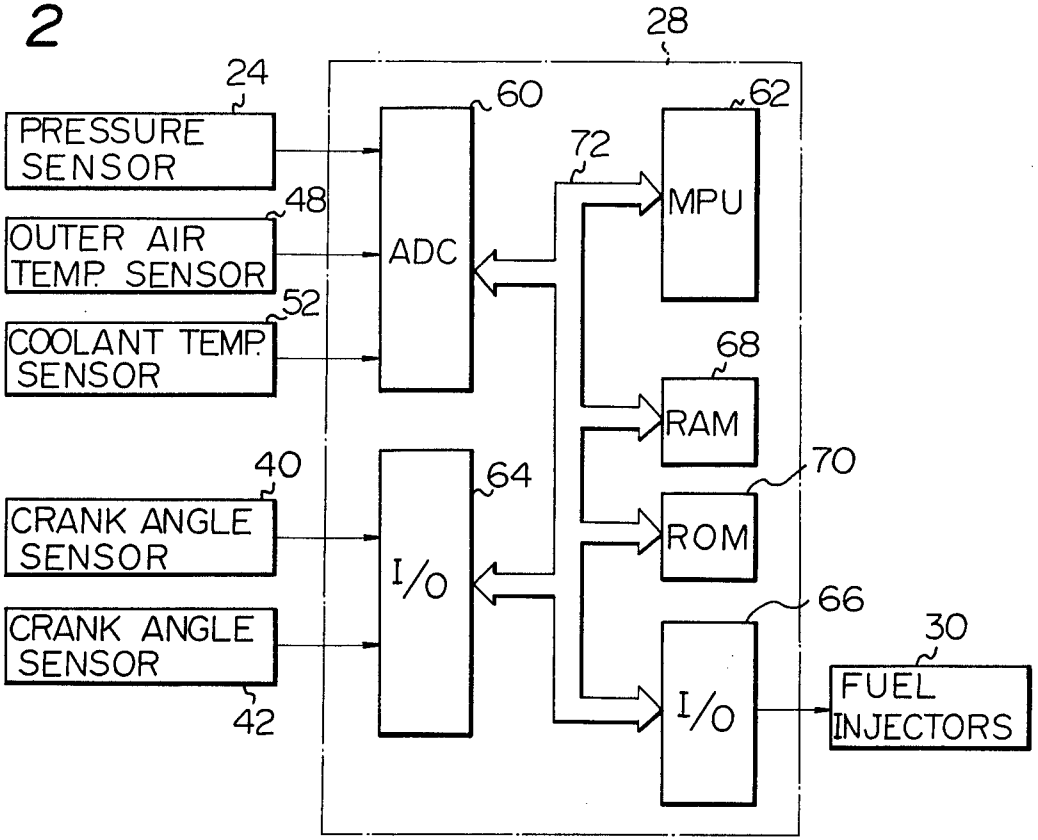
FIG. 2 is a block diagram of a control circuit shown in FIG. 1.

FIG. 2 illustrates an example of the control circuit 28 of FIG. 1. In FIG. 2, the pneumatic pressure sensor 24, outer air temperature sensor 48, crank angle sensors 40 and 42, coolant temperature sensor 52, and fuel injectors 30 are represented by blocks.

The output voltages from the pneumatic pressure sensor 24, outer air temperature sensor 48 and coolant temperature sensor 52 are applied to an analog-to-digital (A/D) converter 60 which contains an analog multiplexer and A/D converter and are sequentially converted into signals in the form of binary numbers in response to instructions from a microprocessor unit (MPU) 62.

The pulse signals produced by the crank angle sensor 40 every 30° crank angle are fed to the MPU 62 via an input-output (I/O) circuit 64 as interrupt-request signals for the interruption routine of every 30° crank angle. The pulse signals from the crank angle sensor 40 are further supplied to a timing counter disposed in the I/O circuit 64 as counting pulses. The pulse signals produced by the crank angle sensor 42 every 360° crank angle are used as reset pulses of the above timing counter. The timing counter produces fuel-injection initiation pulses which are fed to the MPU 62 as interrupt-request signals for the injection interruption routine.

In an I/O circuit 66, a drive circuit which receives a one bit injection pulse having a pulse width TAU calculated by the MPU 62 and converts the injection pulse into a drive signal is provided. The drive signal from the drive circuit is fed to the fuel injectors 30 to inject into the engine a quantity of fuel corresponding to the pulse width TAU.

The A/D converter 60 and I/O circuits 64 and 66 are connected via a bus 72 to the MPU 62, a random access memory (RAM) 68, and a read only memory (ROM) 70, which constitute the microcomputer. The data are transferred via the bus 72.

In the ROM 70 are stored beforehand a routine program for main processing, an interrupt-processing program executed at every 30° crank angle, another routine program, and various types of data or tables which are necessary for carrying out arithmetic calculations.

Hereinafter, the operation of the microcomputer will be illustrated with reference to the flow diagrams of FIGS. 3 and 4.

Figure 3:
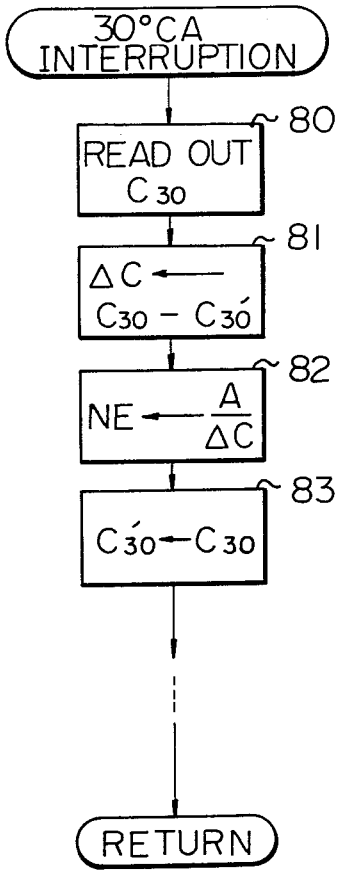
FIGS. 3 and 4 are flow diagrams of parts of the control programs of a microcomputer in the control circuit of FIG. 2.

When a pulse signal at every 30° crank angle is applied from the crank angle sensor 40, the MPU 62 executes the interrupt-processing routine shown in FIG. 3 for producing rpm data which indicates the running speed NE of the engine.

At a point 80, the contents of a free-run counter provided in the MPU 62 are read out and temporarily stored in a register in the MPU 62 as $C_{30}$. At a point 81, the difference $\Delta C$ between contents $C_{30}$ of the free-run counter which are read out in the present interruption process and contents $C_{30}'$ of the free-run counter, which contents were read out in the last interruption process is calculated from $\Delta C = C_{30} - C_{30}'$. Then, at a point 82, the reciprocal of the difference $\Delta C$ is calculated to obtain the running speed NE. Namely, at the point 82, calculation of $NE = A/\Delta C$ is executed, where A is a constant. The calculated NE is stored in the RAM 68. At a point 83, contents $C_{30}$ in the present interruption process are stored in the RAM 68 as contents $C_{30}'$ of the free-run counter in the last interruption process and are used in the next interruption process. Thereafter, another process is executed in the interrupt-processing routine and the the program returns to the main processing routine.

The MPU 62 further introduces binary signals which correspond to the output voltages of the pneumatic pressure sensor 24, the outer air temperature sensor 48, and the coolant temperature sensor 52 from the A/D converter 60 in response to the interrupt request which occurs at every completion of A/D conversion. Then, the MPU 62 stores the introduced binary signals in the RAM 68.

Figure 4:
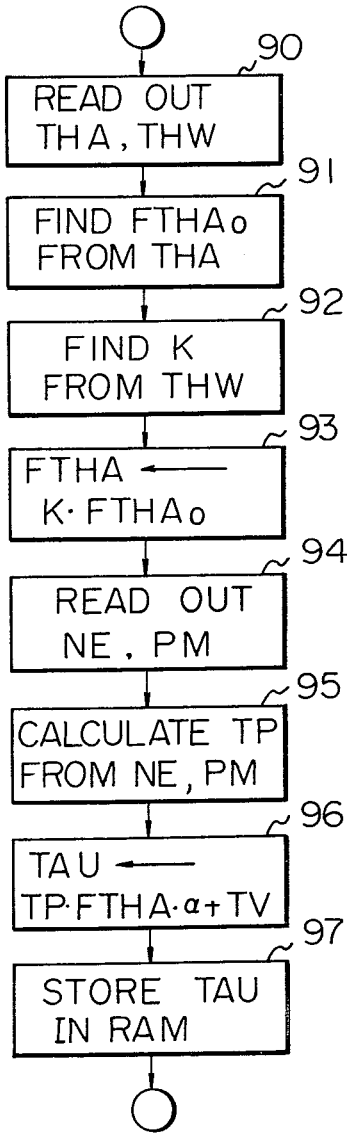
Figure 5:
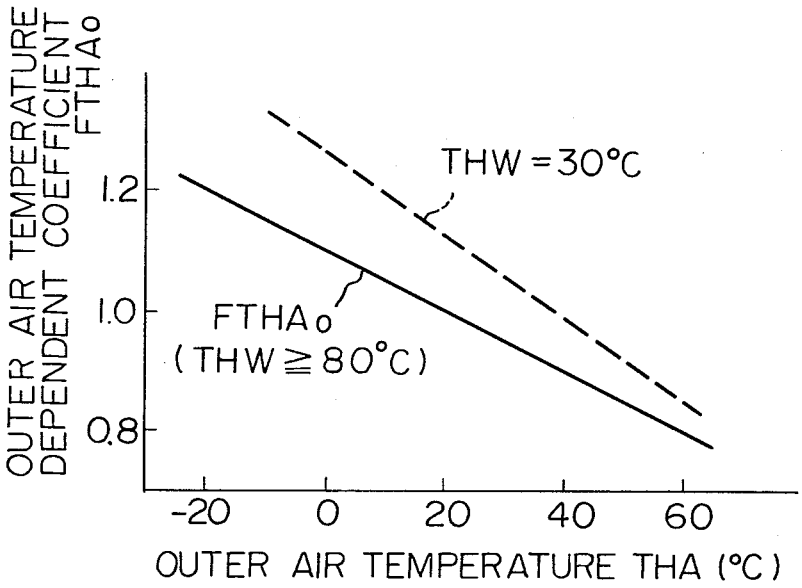
FIG. 5 is a graph of the relation between the outer air temperature and an outer air temperature dependent coefficient.

During the main processing routine, the MPU 62 executes the processing shown in FIG. 4. First, at a point 90, the MPU 62 reads out the data related to outer air temperature THA and coolant temperature THW from the RAM 68. At a point 91 the MPU 62 finds an outer air temperature dependent coefficient $FTHA_0$ at the time the engine is fully warmed-up ($THW \geqq 80°$ C.). The coefficient $FTHA_0$ is a function of the outer air temperature THA. A relationship between $FTHA_0$ and THA is shown by a solid line in FIG. 5. That is, $FTHA_0$ is equal to 1.0 when THA is equal to 20° C., $FTHA_0$ increases when THA decreases to less than 20° C., and $FTHA_0$ decreases when THA increases to greater than 20° C. In the ROM 70, the above function $THA - FTHA_0$ is beforehand stored as a function table, and thus the MPU 62 finds $FTHA_0$ depending upon THA by interpolation, at the point 91.

Figure 6:
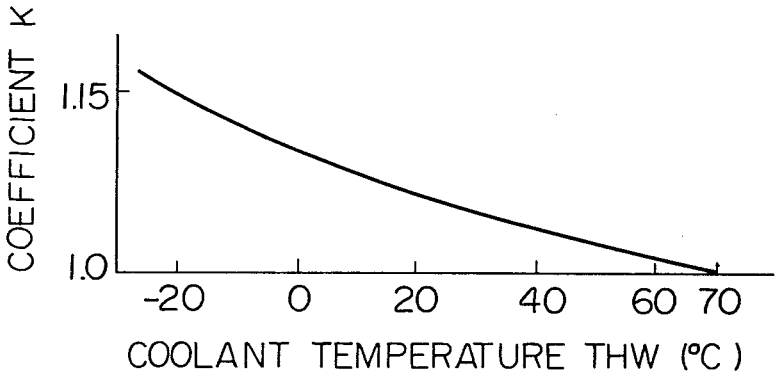
FIG. 6 is a graph of the relation between the coolant temperature and a coefficient.

At a point 92, a coefficient K is found depending upon the read data indicative of the coolant temperature THW. The coefficient K is a function of the coolant temperature THW. The relationship between K and THW is as shown in FIG. 6. That is, K is equal to 1.0 when THW is equal to or greater than 70° C., and K increases when THW decreases to less than 70° C. The function of $THW - K$ is stored in the ROM 70 as a function table or provided in the program as a algebraic formula of $K = A \cdot THW + B$, where A and B are constants. In the point 92, K is found from THW by using such a function table or formula.

At a point 93, a final outer air temperature dependent coefficient FTHA is calculated from $FTHA_0$ and K by using a relation of $FTHA = K \cdot FTHA_0$. At a point 94, the MPU 62 reads out the data related running speed NE and intake manifold absolute pressure PM from the RAM 68. Then, at a point 95, the MPU 62 calculates a basic pulse width TP of the injection signal by interpolation using a function table relying upon the running speed NE and intake manifold absolute pressure PM. That is, the ROM 70 stores, beforehand, the following function table of basic pulse width TP (msec) relative to the running speed NE and the intake manifold absolute pressure PM. Thus, the basic pulse width TP can be calculated by interpolation using the function table relying upon the detected data NE and PM which have been stored in the RAM 68.

| | NE | | | | | | |
|---|---|---|---|---|---|---|---|
| PM | 500 | 1000 | 2000 | 3000 | 4000 | 5000 | 6000 |
| 200 | 1.50 | 1.55 | 1.60 | 1.65 | 1.70 | 1.65 | 1.60 |
| 300 | 2.30 | 2.35 | 2.40 | 2.45 | 2.50 | 2.45 | 2.40 |
| 400 | 3 10 | 3.15 | 3.20 | 3.25 | 3.30 | 3.25 | 3.20 |
| 500 | 3.80 | 3.85 | 3.90 | 3.95 | 4.00 | 3.95 | 3.90 |
| 600 | 4.55 | 4.60 | 4.65 | 4.70 | 4.75 | 4.70 | 4.65 |
| 700 | 5.30 | 5.35 | 5.40 | 5.45 | 5.50 | 5.45 | 5.40 |
| 800 | 6.05 | 6.10 | 6.15 | 6.20 | 6.25 | 6.20 | 6.15 |

NE (rpm),
PM (mmHg abs)

Then, at a point 96, the MPU 62 calculates a final pulse width TAU based upon the basic pulse width TP, outer air temperature dependent coefficient FTHA, another correction coefficient $\alpha$, and the dead injection pulse width TV of the fuel injector 30, according to the following relation, $$TAU = TP \cdot FTHA \cdot \alpha + TV$$

The calculated data for the pulse width TAU is stored in a predetermined position of the RAM 68 at a point 97.

There are various methods for producing an injection signal having a duration corresponding to the calculated pulse width TAU. One method is as follows. First, the injection signal is inverted from "0" to "1" and the contents of the free-run counter is read out when a fuel-injection initiation pulse is produced. By using the read out contents, a value corresponding to contents of the free run counter after the time of TAU has elapsed from the development of the fuel-injection initiation pulse is calculated. The calculated value is set to a compare register. When the contents of the free-run counter become equal to the contents in the compare register, an interrupt-request signal is produced to invert the injection signal from "1" to "0". Accordingly, an injection signal having a duration which corresponds to TAU is formed. The above fuel-injection initiation pulse is produced each time the interrupt-processing routine of 30° crank angle shown in FIG. 3 is executed several times.

In general, the outer air temperature sensor 48, which is in general disposed in an entrance portion of the intake passage 12 as shown in FIG. 1, detects the temperature of outer air introduced into the intake passage 12. While the outer air passes through the intake passage 12 to the combustion chamber 14, the temperature thereof changes depending upon the temperature of the intake passage 12. So the air temperature introduced into the combustion chamber 14 differs from the temperature detected by the outer air temperature sensor 48. If the temperature of the intake passage 12 is always constant, accurate correction of the density of air can be executed due to a fixed relativity between the detected air temperature and the actual air temperature according to the conventional system. If the intake passage temperature varies, however, accurate correction of the air density depending upon only the detected temperature from the outer air temperature sensor 48 is impossible according to the conventional system.

In the above-mentioned embodiment, the changing amount of the outer air temperature dependent coefficient FTHA is changed in accordance with the coolant temperature, which corresponds to the intake passage temperature. That is, the lower the coolant temperature, the greater the changing amount of FTHA, when the coolant temperature is lower than that at a fully warmed-up time. For example, when the coolant temperature THW is THW=30° C., FTHA is controlled to be as shown by a broken line in FIG. 5. Therefore, according to the present invention, air density can be accurately corrected depending upon the actual temperature of air introduced into the combustion chamber 14, and, thus, deviation of the air-fuel ratio due to the change in the density of the introduced air can be very accurately compensated.

In the aforementioned embodiment, the coolant temperature is used as the temperature corresponding to the air intake passage temperature. However, instead of the coolant temperature, the engine oil temperature or engine block temperature can be used as the temperature corresponding to the air intake passage temperature.

As many widely different embodiments of the present invention may be constructed without departing from the spirit and scope of the present invention, it should be understood that the present invention is not limited to the specific embodiments described in this specification, except as defined in the appended claims.

We claim:

1. A method of controlling the fuel supply of an internal combustion engine having combustion chambers, an intake manifold, and an air intake passage for introducing outer air into the combustion chamber, said method comprising the steps of:

detecting an engine running speed to produce a first electrical signal;

detecting an intake manifold pneumatic pressure to produce a second electrical signal;

detecting a temperature of the outer air of the engine to produce a third electrical signal;

detecting a temperature corresponding to the temperature of the air intake passage to produce a fourth electrical signal;

calculating, in response to the first and second electrical signals, a value which corresponds to a basic fuel feed to the engine;

determining, in response to the third electrical signal, a first correction coefficient by using a predetermined first function which indicates a relationship between the outer air temperature and the first correction coefficient, said first correction coefficient corresponding to an outer air temperature dependent coefficient at the time of a fully warmed-up condition;

determining, in response to the fourth electrical signal, a second correction coefficient by using a predetermined second function which indicates a relationship between the temperature and the second correction coefficient;

determining, in accordance with said first and second correction coefficients, a third correction coefficient, a changing rate of the third correction coefficient with respect to the outer air temperature increasing when the temperature decreases, and decreasing when the temperature corresponding to the air intake passage temperature increases;

correcting, in accordance with said third correction coefficient, the calculated value for the fuel feed so that the corrected value for the fuel feed is proportional to said third correction coefficient; and adjusting, in response to the corrected value for the fuel feed, the actual fuel feed to the engine.

2. An apparatus for controlling the fuel supply of an internal combustion engine having combustion chambers, an intake manifold, and an air intake passage for introducing outer air into the combustion chamber, said apparatus comprising:

means for detecting an engine running speed to produce a first electrical signal;

means for detecting an intake manifold pneumatic pressure to produce a second electrical signal;

means for detecting a temperature of the outer air of the engine to produce a third electrical signal;

means for detecting a temperature corresponding to the temperature of the air intake passage to produce a fourth electrical signal;

processing means for (1) calculating, in response to the first and second electrical signals, a value which corresponds to a basic fuel feed to the engine, (2) determining, in response to the third electrical signal, a first correction coefficient by using a predetermined first function which indicates a relationship between the outer air temperature and the first correction coefficient, said first correction coefficient corresponding to an outer air temperature dependent coefficient at the time of a fully warmed-up condition, (3) determining, in response to the fourth electrical signal, a second correction coefficient by using a predetermined second function which indicates a relationship between the temperature corresponding to the air intake passage temperature and the second correction coefficient, (4) determining, in accordance with said first and second correction coefficients, a third correction coefficient, a changing rate of the third correction coefficient with respect to the outer air temperature increasing when the temperature corresponding to the air intake passage temperature decreases, and decreasing when the temperature corresponding to the air intake passage temperature increases, and (5) correcting, in accordance with said third correction coefficient, the calculated value for the fuel feed so that the corrected value for the fuel feed is proportional to said third correction coefficient; and means for adjusting, in response to the correct value for the fuel feed, the actual fuel feed to the engine.

3. A method as claimed in claim 1, wherein said outer air temperature detecting step includes a step of detecting the temperature of air in an entrance portion of the air intake passage.

4. A method as claimed in claim 1 wherein said step of detecting temperature corresponding to the air intake passage temperature includes a step of detecting the temperature of the engine coolant to produce a fourth electrical signal.

5. A method as claimed in claim 1 wherein said predetermined first function is a decreasing function with respect to the outer air temperature.

6. A method as claimed in claim 1 wherein said predetermined second function is a decreasing function with respect to the temperature corresponding to the air intake passage temperature.

7. An apparatus as claimed in claim 2 wherein said outer air temperature detecting means includes a means for detecting the temperature of air in an entrance portion of the air intake passage.

8. An apparatus as claimed in claim 2 wherein said means for detecting temperature corresponding to the air intake passage temperature includes a means for detecting the temperature of the engine coolant to produce a fourth electrical signal.

9. An apparatus as claimed in claim 2 wherein said predetermined first function is a decreasing function with respect to the outer air temperature.

10. An apparatus as claimed in claim 1 wherein said predetermined second function is a decreasing function with respect to the temperature corresponding to the air intake passage temperature.

* * * * *